US006629523B2

(12) United States Patent
Saltzman et al.

(10) Patent No.: US 6,629,523 B2
(45) Date of Patent: Oct. 7, 2003

(54) HEATED MAKE-UP AIR SYSTEM

(75) Inventors: Todd J. Saltzman, Raleigh, NC (US); William B. Griffin, Raleigh, NC (US)

(73) Assignee: Captive-Aire Systems, Inc., Youngsville, NC (US)

( * ) Notice: Subject to any disclaimer, the term of this patent is extended or adjusted under 35 U.S.C. 154(b) by 9 days.

(21) Appl. No.: 09/758,669

(22) Filed: Jan. 11, 2001

(65) Prior Publication Data

US 2002/0088456 A1 Jul. 11, 2002

(51) Int. Cl.[7] ..... F24H 3/02

(52) U.S. Cl. ..... 126/110 C; 126/110 A; 236/45; 432/222

(58) Field of Search ..... 126/299 R, 299 D, 126/110 A, 110 B, 110 C, 110 R, 92 C; 236/1 G, 45; 432/222; 16/304, 307, 308

(56) References Cited

U.S. PATENT DOCUMENTS 696,914 A * 1/1902 Swanson ..... 126/285 R
3,199,848 A * 8/1965 Harrison ..... 126/110 C
3,591,150 A * 7/1971 Weatherston ..... 126/110 C
3,641,623 A * 2/1972 Weiss ..... 16/149
4,429,679 A * 2/1984 Dirkes ..... 126/110 A
4,674,475 A * 6/1987 Powis ..... 126/110 B
4,823,438 A * 4/1989 Roloff ..... 16/304
4,917,074 A * 4/1990 Brekke ..... 126/110 A
5,915,960 A * 6/1999 Check et al. ..... 126/110 C
6,061,874 A * 5/2000 Tatara ..... 16/304

* cited by examiner

*Primary Examiner*—James C. Yeung

(57) ABSTRACT

A heated make-up air system comprising a duct structure having a direct gas fired burner mounted therein. Adjacent the burner there is provided an opening for permitting air to flow there through. Mounted adjacent the opening one or more pivotally mounted panels or profile plates. The moveable panels or profile plates are spring-biased to assume a normally closed position. However, the moveable panels are moveable from the closed position to an open position in order to control air flow through the duct structure and past the burner.

12 Claims, 5 Drawing Sheets

HEATED MAKE-UP AIR SYSTEM

FIELD OF INVENTION

The present invention relates to heated make-up air systems, and more particularly to a heated make-up air system having controls for controlling the flow of air through the system.

BACKGROUND OF THE INVENTION

Commercial kitchens typically include one or more exhaust fans that remove smoke, steam and other air polluting substances from areas around stoves, grills, ovens, dishwashers, etc. To replenish the exhausted air, commercial kitchens typically utilize what is termed make-up air systems that draw outside air into the kitchen. These make-up air systems basically comprise a duct structure open to both the outside air and the kitchen, a fan for blowing air through the duct structure into the kitchen, and a direct-fired gas burner for heating the air passing through the duct.

As is appreciated, in order to maintain optimum burner efficiency, it is important to provide the proper mixture of air and gas at the burner site. This essentially means that the flow of air through the duct and past the burner should be controlled. It is recognized that the differential pressure across the burner is an important parameter to consider when controlling the flow of air through the duct and when attempting to maintain optimum burner efficiency. More particularly, it is desirable to maintain the pressure differential across the burner generally constant during the operation of the burner. In controlling the pressure differential across the burner, heating systems in the past have achieved this by varying the flow rate of air passing the burner.

One such approach to controlling the flow of air past the burner has entailed the use of motorized dampers such as disclosed in U.S. Pat. No. 3,591,150. Typically, these dampers are located adjacent the burner, just downstream from the burner, and are designed to open and close and consequently vary the open area within the duct through which the air passes. This effectively varies the flow rate of air through the duct and past the burner and in the process tends to control the volume and velocity of air passing adjacent the burner and in the end does in fact control, to at least some degree, the pressure differential across the burner. However, systems such as motorized dampers are often slow to react to changes in air flow upstream from the burner or other air flow parameters that impact air flow and air velocity and consequently the pressure differential across the burner. Consequently, because of such slow reaction times, motorized dampers of the type disclosed in U.S. Pat. No. 3,591,150 do not always maintain the optimum air flow conditions around a direct-fired gas burner.

SUMMARY OF THE INVENTION

The present invention entails a make-up air system for heating outside air and directing the heated air into a kitchen or other areas to replace exhausted air. This system comprises a duct structure and a fan for moving air through the duct. A direct-fired burner is provided for heating the air moving through the duct. Disposed adjacent the burner is at least one spring biased moveable panel or profile plate for varying the air flow past the burner and through the duct.

In one embodiment of the present invention the spring-biased moveable panel functions to control the air flow through the duct and past the direct-fired burner.

Specifically, the control is aimed at maintaining a generally constant differential pressure across the burner.

In one particular embodiment of the present invention, the direct-fired burner is mounted within a duct structure. Adjacent the burner there is provided an opening in the duct through which air passes. A pair of pivotally mounted and laterally spaced moveable panels are mounted in the opening, with each panel being moveable from a closed position to an open position. Each of the panels are spring-biased towards the closed position. Thus, as the flow rate of air increases through the duct, the pressure associated with the increased flow rate is effective to open the moveable panels and consequently vary the flow rate through the duct and past the burner.

DETAILED DESCRIPTION OF THE INVENTION

Figure 1:
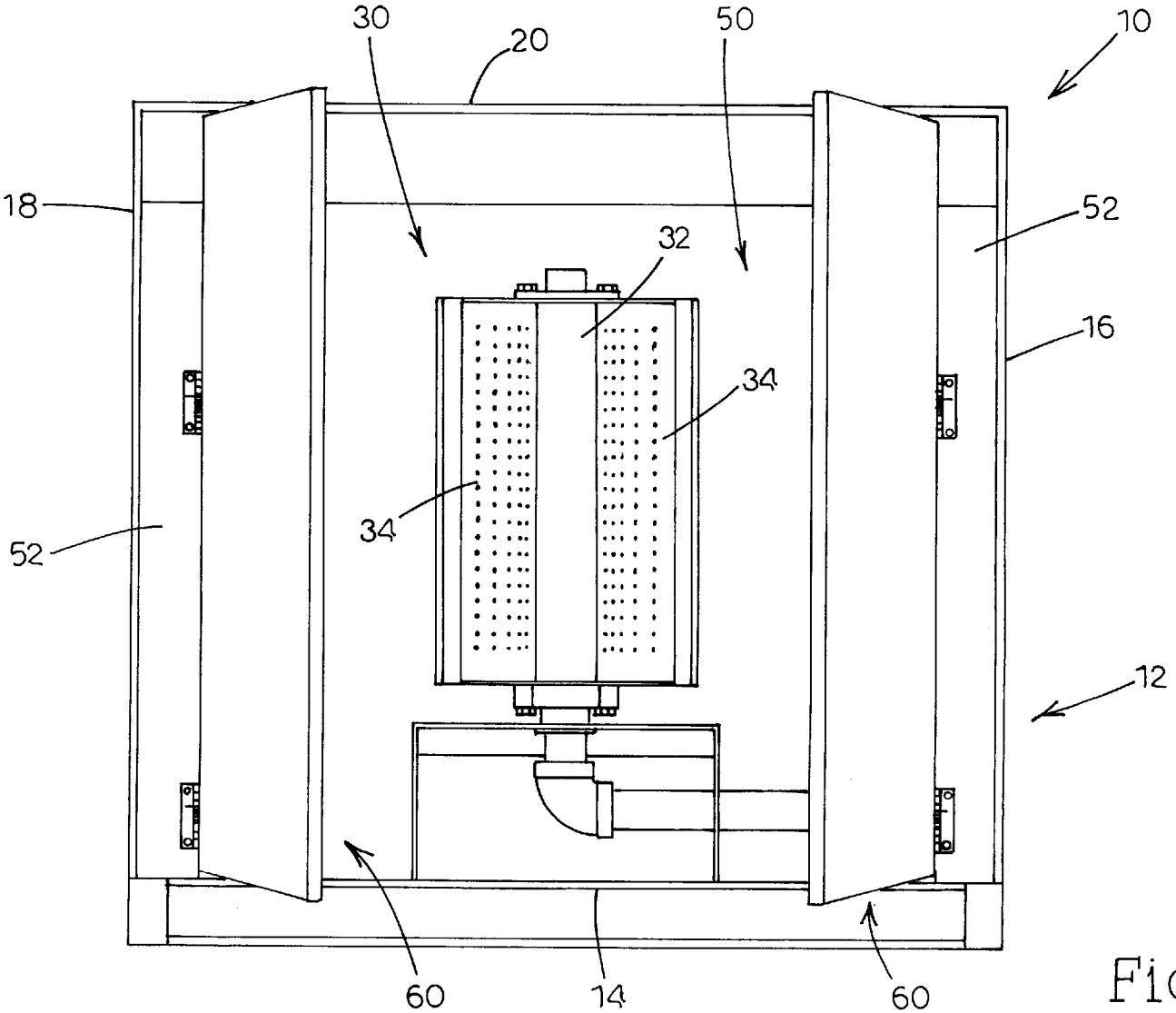
FIG. 1 is a fragmentary perspective view showing a portion of a make-up air system in accordance with the present invention.

With further reference to the drawings, the make-up air system of the present invention is shown therein and indicated generally by the numeral 10. The make-up air system 10 basically includes a duct structure 12, a direct-fired gas burner 30, a fan 40, and a pair of pivotally mounted panels 60 that as will be discussed subsequently in detail, control the flow of air through the duct structure 12 and in effect provides optimum quantities of air to the burner in order to provide an efficient and effective combustion process.

Turning first to the duct structure 12, it is seen that in the case of the particular design illustrated herein that the duct structure 12 includes a bottom 16, a pair of sides 16 and 18, and a top 20. Although the make-up air system 10 can be used in various applications, one particular application entails its use in a commercial kitchen environment. In that application, the duct structure 12 is open to outside air. That is, the fan 40 incorporated into the duct structure 12 induces or pulls outside or ambient air into the duct and thereafter the air is directed through the duct to where it is ultimately discharged into a kitchen area.

Figure 2:
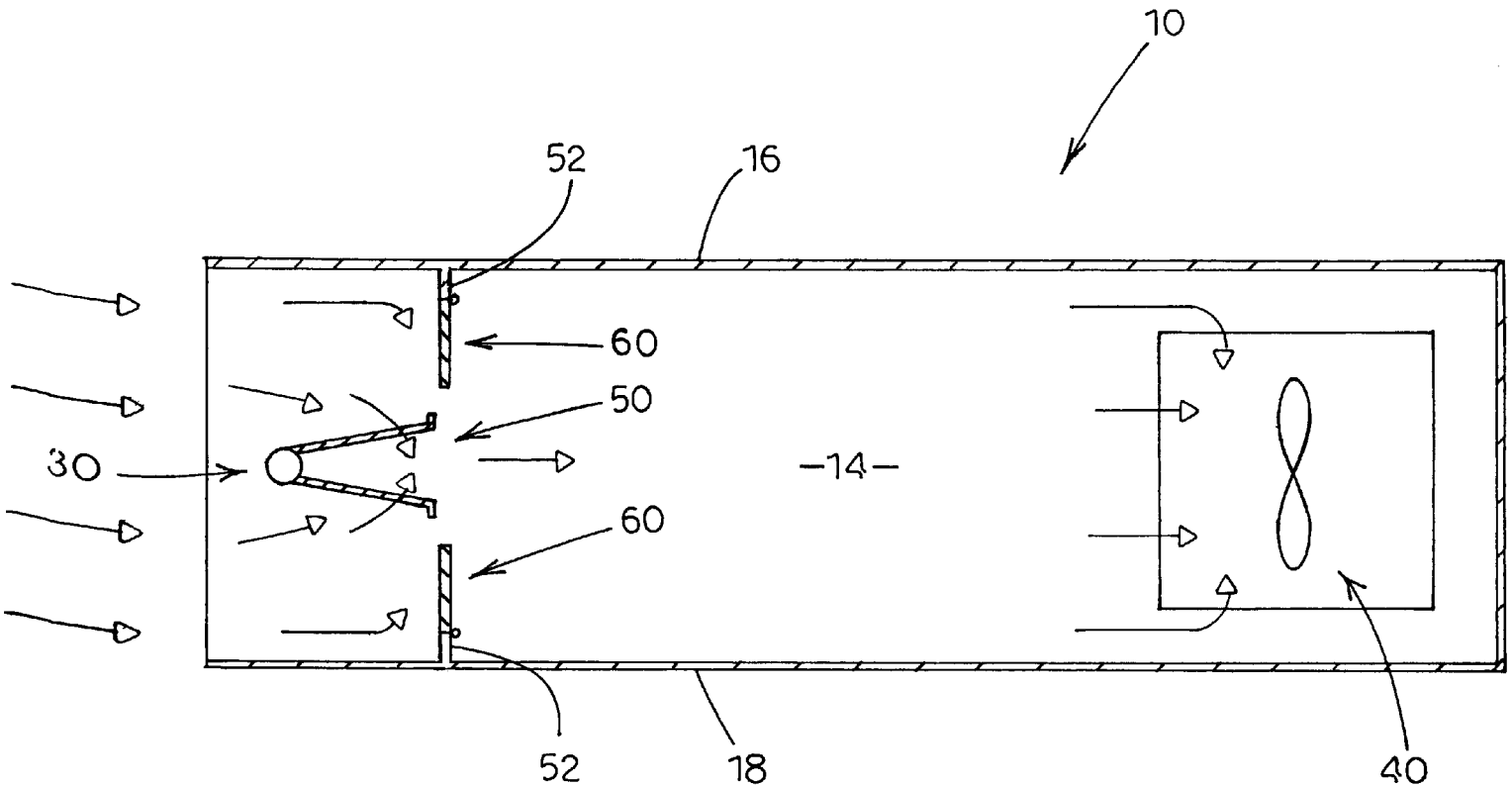
FIG. 2 is a schematic illustration of a portion of the make-up air system of the present invention showing the spring-biased moveable panels in their closed position.
Figure 3:
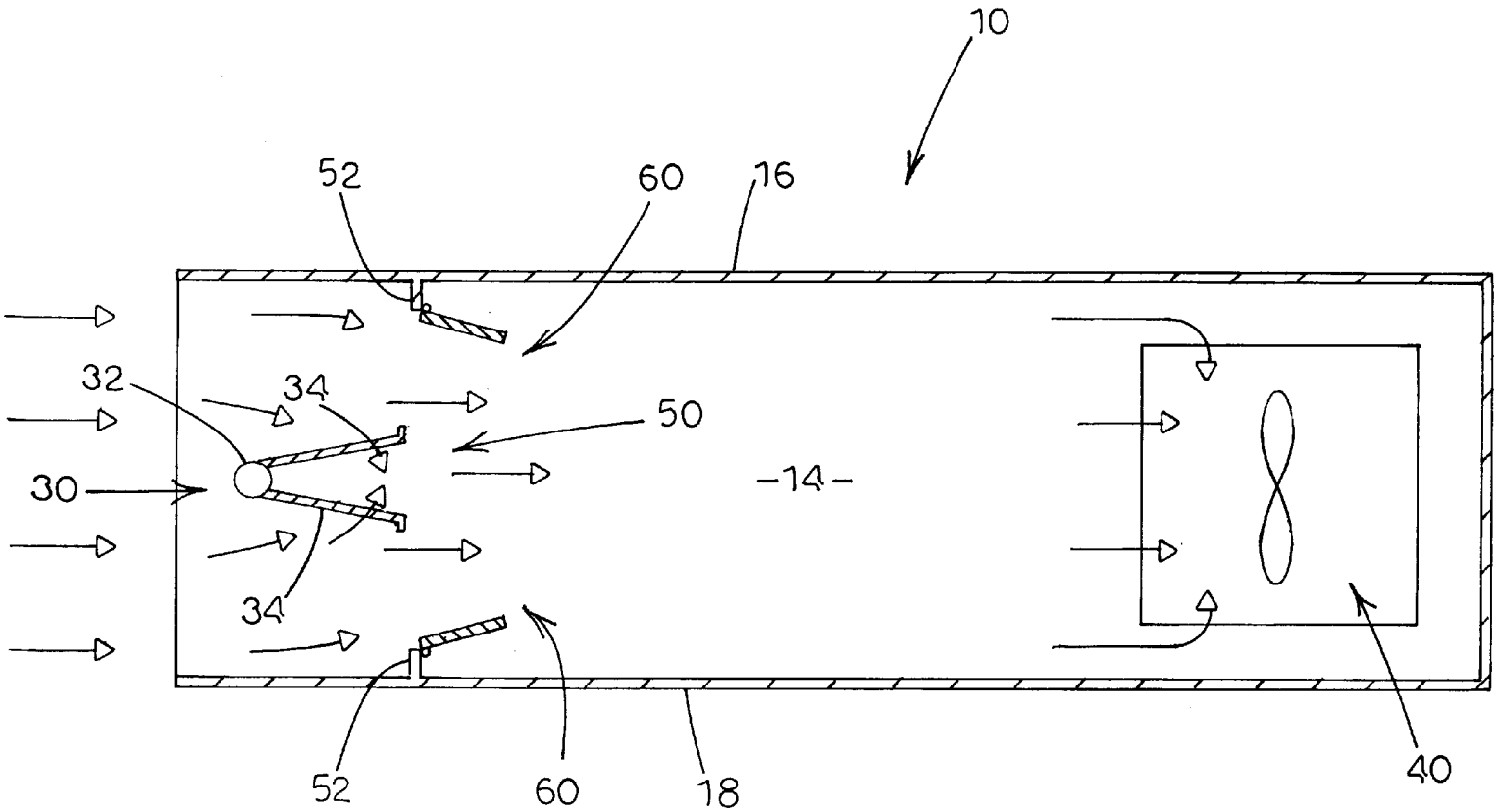
FIG. 3 is a view similar to FIG. 2 except that the spring-biased moveable panels are shown in an open position.

Disposed within the duct structure 12 is a burner indicated generally by the numeral 30. Burner 30 comprises a direct-fired burner and in most cases would comprise a direct-fired gas burner. As illustrated in the drawings, burner 30 includes a manifold 32 and a pair of diverging mixing plates 34 that extend therefrom in a downstream direction relative to the air flow through the duct structure, as shown in FIGS. 2 and 3.

In the make-up air system 10 shown herein, the fan 40 is disposed downstream from the burner 30. Thus, the fan essentially induces air into an inlet end of the duct structure 12 and thereafter the air flows past the burner and through the fan to an outlet. Various types of fans can be utilized. In the make-up air system 10 shown herein, it is contemplated that the fan 40 would be of a squirrel cage type design.

Disposed transversely across the duct structure 12 adjacent the downstream portion of the burner 30 is an opening indicated generally by the numeral 50. Essentially this opening 50 defines an area through which air passes as the air leaves the burner 30 and is directed downstream towards an outlet. In the case of the present disclosure, the opening 50 may be defined by one or more supports or reinforcing structures that are secured interiorly of the walls of the duct structure 12. In particular, as seen in FIGS. 1–3, there is provided a pair of supports 52 that are secured adjacent opposed sides 16 and 18 of the duct structure 12. Mounted to the supports 52 are a pair of moveable panels 60. These panels 60 may be referred to as profile plates or even dampers. Each panel 60 includes an outboard edge and an inboard edge. The outboard edges of the moveable panels 60 are secured to a respective support 52 by a hinge. The hinge includes a pair of brackets 62 and 64 and a hinge pin interconnecting the brackets. Thus, as seen in the drawings, each moveable panel 60 is pivotally mounted in the duct structure 12 and is moveable from a closed position, shown in FIG. 2, to an open position shown in FIG. 3. As used herein, the term "closed position" corresponds to the position that the moveable panels assume in FIG. 2. There the moveable panels 60 extend generally transversely across the opening 50 and in the case of a straight or elongated duct structure such as illustrated herein, in the closed position, the panels 60 are disposed generally normal to the direction of air flow through the duct structure 12. The moveable panels, as alluded to above, are moveable from the closed position in FIG. 2 to an open position shown in FIG. 3. However, the term "open position" as used herein, means any position that the moveable panel 60 assumes except the closed positions. That is, although the moveable panels may only move slightly from their closed positions, this will nevertheless constitute an open position because it effectively increases the area of the opening 50 compared to the area of the opening when the moveable panel 60 are disposed in their closed position.

Figure 4:
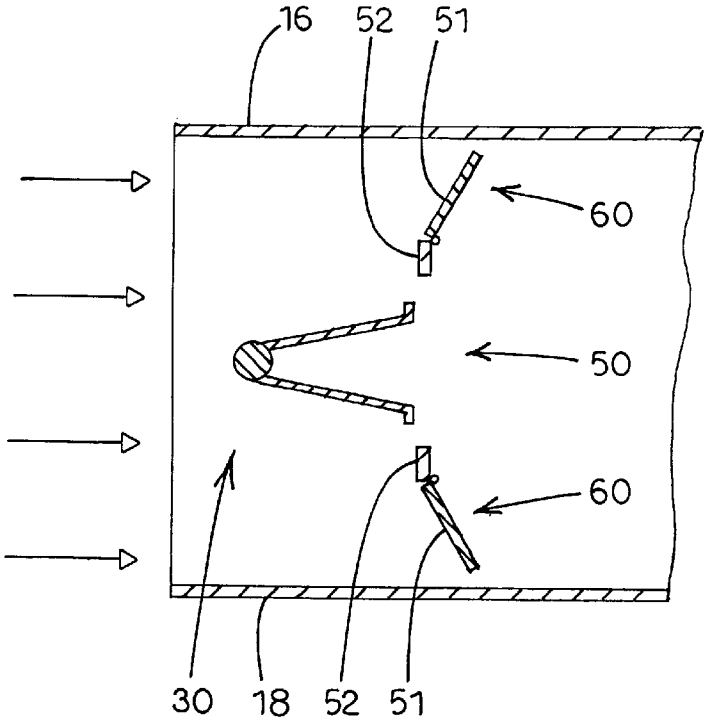
FIG. 4 is a schematic illustration of an alternate design for the make-up air system of the present invention.
Figure 6:
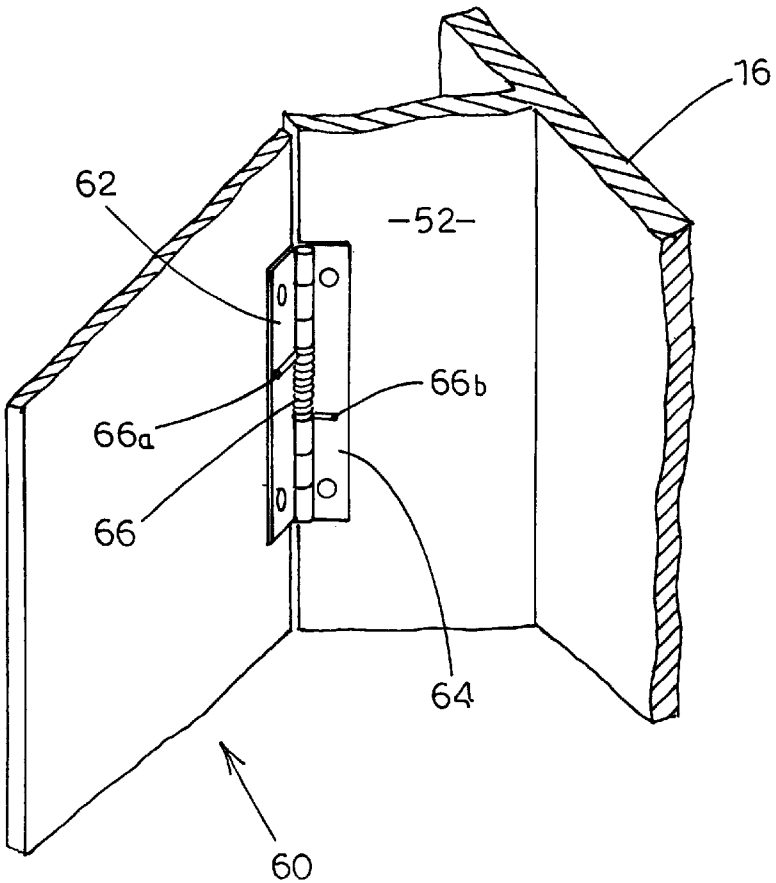
FIG. 6 is a fragmentary perspective view showing a portion of a spring-biased moveable panel.

The moveable panels 60 are spring-biased towards the closed position. To provide for the spring biasing of the moveable panels 60, a coil spring 66 is disposed around the hinge pin of each hinge structure. Coil spring 66 includes two terminal ends, terminal ends 66*a* and 66*b*. As illustrated in FIG. 4, the first terminal end, that is terminal end 66*c* is engaged with the bracket 62 that is in turn secured to the moveable panel 60. The second terminal end 66*b* is engaged with bracket 64 which is secured to the adjacent support 52. Consequently, as a respective moveable panel 60 is rotated from the closed position, it is appreciated that the biasing action of the spring 66, through the terminal end 66*a*, tends to bias the moveable panel 60 towards the closed position.

The disposition of the burner 30 and the moveable panels 60 may vary. In the embodiment illustrated in FIGS. 2 and 3, the burner is generally centrally located within the duct 12 and the two moveable panels 60 are spaced inwardly from the outer walls 16 and 18. Further, the supports 52 that support the moveable panels 60 are disposed outwardly of the moveable panels 60 and essentially extend inwardly from the outer wall 16 and 18 of the duct 12. However, as noted above, the position of the moveable panels 60 can vary with respect to the burner 30, and further the number of moveable panels 60 employed can also vary.

Turning to FIG. 4, an alternate embodiment is shown therein. Here the burner 30 is again generally centrally located. However, the moveable panels 60 have been both repositioned to lie adjacent the outer sides of the duct and generally outwardly of the supports 52. In particular, the supports 52 help define the opening 50 through which air passes through the duct 12. The moveable panels 60 are moveably connected to the outboard edges of the supports 52. Thus, in the closed position, the moveable panels 60 generally extend transversely across the duct 12 and close the area between the respective sidewall 16 and 18 and the supports 52. Thus, it is appreciated that as the moveable panels 60 move from a closed position to an open position as illustrated in FIG. 4, that an opening or air passageway area 51 is formed between the sidewalls 16 and 18 of the duct and the supports 52. Again, when the moveable panels 60 assume the closed position, then air is constrained to move through the central opening 50 defined between the supports 52.

Figure 5:
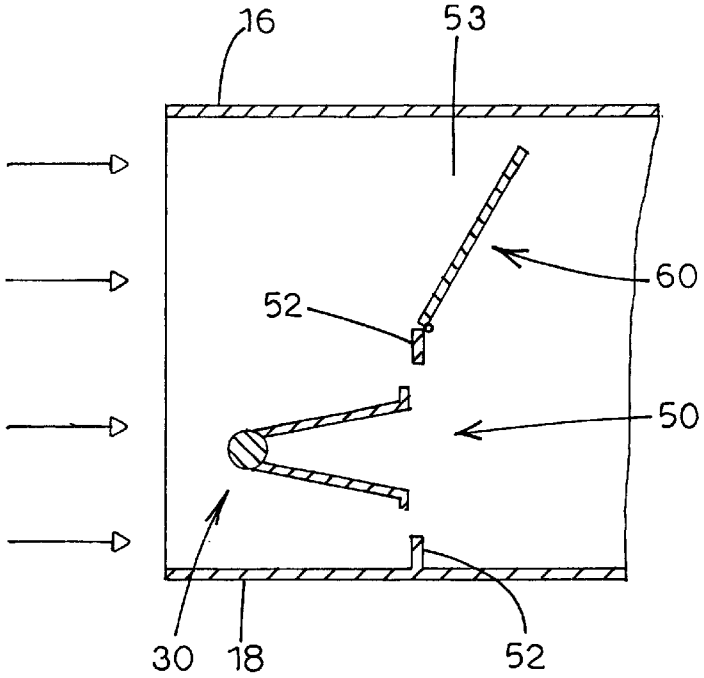
FIG. 5 is a schematic illustration showing another alternative embodiment for the make-up air system of the present invention.

Turning to FIG. 5, another embodiment for the make-up air system of the present invention is shown therein. In this particular embodiment, the burner 30 is shifted (off-set) to one side of the duct 12 and only one moveable panel 60 is employed for controlling the flow of air past or through the burner 30. In this case, the supports 52 are generally uniformly spaced on each side of the burner 30 and define the opening or passageway 50 there between. In the case of one of the supports 52, a single moveable panel 60 is pivotally connected to an inboard side thereof. As illustrated in FIG. 5, the movable panel 60 is moveable from a closed position to an open position. In the closed position, the moveable panel extends generally transversely across the duct 12 and from the adjacent support 52 to the opposite side 18 of the duct 12. Therefore, in the closed position air is constrained to move or flow through the opening 50 defined between the supports 52. However, as the moveable panel 60 moves from the closed position to the open position it is appreciated that an opening 53 is created between the terminal end of the moveable panel 60 and the adjacent side or wall 18 of the duct. This opening allows some air to bypass the burner 30 and to generally pass through the duct via the opening 53 formed between the moveable panel 60 and the adjacent side wall 18.

It is thusly appreciated, that the moveable panels 60 have the ability to vary and control the flow of air through the opening 50. That is, as the flow rate of air increases upstream from the movable panels 60, it is appreciated that in certain situations the increased flow of air along with increases in total pressure within the system, will result in the moveable panels 60 rotating from the closed position to an open position. The degree to which the moveable panels 60 open will, of course, depend upon the air flow and the accompanying total pressure existing on the upstream side of the panels. It follows that as the panels 60 rotate to one or more open positions, that the area of the opening 50 in the embodiment of FIGS. 2 and 3 will increases and consequently permits a greater air flow through the opening 50. Thus, in the end, the panels 60 through the springs 66 associated with the respective hinges, control the air flow passing through the burner 30 and consequently have an impact on the combustion efficiency of the burner.

With respect to combustion efficiency, it is sometimes recommended that to optimize combustion efficiency of direct-fired burner, that this can be achieved by maintaining the pressure differential across the burner generally constant. Therefore, in at least one mode of operation, the moveable panel or panels 60 along with the springs 66 are designed to regulate air flow through the duct structure 12 so as to maintain a generally constant pressure differential across the burner. In general, the panel or panels 60 tend to control the flow of air so as to maintain the flow of air through the burner 30 generally constant. To achieve this, the springs 66 are selected according to certain characteristics such as spring constant, etc. to provide such control over the air flow through the duct and ultimately some measure of control over the pressure differential across the burner. While the desired pressure differential across the burner may vary, it is contemplated that a differential pressure in the range of 0.20–0.30 inches of water column constitutes an acceptable pressure differential for a direct-fired gas burner of the type disclosed herein.

The present disclosure has focused on the spring-biased panels 60 that form a part of the make-up air system 10 of the present invention. Details of the make-up air system 10 have not been dealt with herein because such is not per se material to the present invention and because such make-up air systems are generally known in the art. However, for a more complete and unified understanding of heating systems and make-up air systems, one is referred to the disclosures found in U.S. Pat. Nos. 5,771,879 and 3,591,150, the disclosures of which are expressly incorporated herein by reference.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. An air heating system comprising:

a. a duct structure;

b. a direct-fired burner disposed within the duct structure;

c. at least one moveable panel disposed within the duct structure adjacent the burner;

d. a spring operative to bias the moveable panel to a selected position and wherein the panel may move against the bias of the spring in response to air flowing past the burner and through the duct structure; and e. wherein the spring comprises a coiled spring having opposed terminal ends wherein one end moves with the panel while the other end is held relatively stationary.

2. The system of claim 1 wherein the panel is pivotally mounted within the duct structure.

3. The system of claim 1 wherein the moveable panel is secured to a support by a hinge having a hinge pin and wherein the spring is disposed around the hinge pin.

4. The system of claim 3 wherein the hinge includes a pair of brackets secured together by the hinge pin and wherein one bracket is secured to the moveable panel while the other bracket is secured to the support and wherein the one terminal end of the spring is engaged with the bracket secured to the moveable panel while the other terminal end engages the bracket secured to the support.

5. The system of claim 1 wherein there is provided a pair of moveable panels with each being biased by one of the springs; and wherein the pair of moveable panels are laterally-spaced apart such that each moveable panel is situated outwardly of the burner.

6. The system of claim 5 wherein the moveable panels normally assume a closed position where they extend transversely across the duct structure generally normal to the direction of air moving through the duct structure.

7. The system of claim 6 wherein each moveable panel is pivotally mounted within the duct and biased to the normal closed position by one of the springs; and wherein each moveable panel is operative to swing open in response to certain increases in air flow rate.

8. A system for heating air, comprising:

a. a duct structure;

b. a direct-fired burner disposed within the duct structure;

c. a pair of laterally-spaced panels pivotally mounted within the duct structure;

d. a spring operative to bias each moveable panel towards a closed position and wherein each panel is pivotally moveable from the closed position to an open position;

e. wherein in the closed position the moveable panels assume a spaced-apart relationship and there is defined an open area there between that permits air to flow there through; and f. wherein the direct-fired burner is disposed in the duct structure such that it generally aligns with the open area defined by the moveable panels.

9. The system of claim 8 wherein the springs bias the panels so as to maintain a generally constant pressure differential across the burner.

10. The system of claim 8 including a fan mounted in the duct structure downstream from the burner.

11. The system of claim 8 wherein each panel is pivotally mounted within the duct structure.

12. The system of claim 11 wherein each panel is pivotally moveable from a closed position to an open position and wherein in the process of moving from the closed position an open position each respective panel moves away from the burner.

* * * * *